US005101511A

United States Patent [19]

Elverskog

[11] Patent Number: 5,101,511

[45] Date of Patent: Apr. 7, 1992

[54] PROTECTIVE JACKET

[75] Inventor: Gerth Elverskog, Wilton, Conn.

[73] Assignee: A.C.E. International, Ltd., Nassau, The Bahamas

[21] Appl. No.: 669,018

[22] Filed: Mar. 13, 1991

[51] Int. Cl.[5] ..... A41D 13/00

[52] U.S. Cl. ..... 2/2.5; 2/92; 2/102; 2/108

[58] Field of Search ..... 2/2.5, 92, 102, 108, 2/2, 70, 115, 106, 69, 71, 72, 93, 114, DIG. 1, 51, 48

[56] References Cited

U.S. PATENT DOCUMENTS

| | | | |
|---|---|---|---|
| 2,388,234 | 11/1945 | Abel . | |
| 2,389,152 | 11/1945 | Keeler et al. | 2/92 |
| 2,747,190 | 5/1956 | Foster | 2/2.5 |
| 3,514,786 | 6/1970 | Terwilliger | 2/2.5 |
| 3,582,988 | 6/1971 | Armellino | 2/2.5 |
| 4,280,342 | 7/1981 | Eng et al. | 2/2 |
| 4,351,065 | 9/1982 | Bouchard . | |
| 4,467,476 | 8/1984 | Herbert | 2/2.5 |
| 4,800,593 | 1/1989 | Ruffner | 2/102 |

FOREIGN PATENT DOCUMENTS

| | | | |
|---|---|---|---|
| 103915 | 2/1917 | United Kingdom | 2/2.5 |
| 108244 | 8/1917 | United Kingdom | 2/2.5 |
| 813487 | 5/1959 | United Kingdom | 2/92 |
| 2219727 | 12/1989 | United Kingdom | 2/2 |

*Primary Examiner*—Werner H. Schroeder
*Assistant Examiner*—Amy B. Vanatta
*Attorney, Agent, or Firm*—Edward R. Hyde

[57] ABSTRACT

A sleeveless jacket that would be worn by the user of a chain saw. The front and shoulders of the jacket are padded with a material that jams a chain saw if it cuts into the padding to protect the user from being cut by the saw.

4 Claims, 1 Drawing Sheet

PROTECTIVE JACKET

BACKGROUND OF THE INVENTION

1. Field of the Invention

The present invention relates to a protective sleeveless jacket that is worn by a chain saw user to protect him from misuse of the saw that may become out of control. The jacket has special utility for a user who is cutting branches of trees that are at shoulder level or overhead. The protective jacket of the present invention was designed to minimize injuries in such cases.

The invention is a unique design of sleeveless jacket or vest in which injuries to the upper part of the body by misuse of the chain saw are prevented or minimized.

2. Description of the Prior Art

Reference is made to applicant's co-pending application Ser. No. 502,928 filed Apr. 2, 1990 that discloses a pair of chaps that are worn over trousers and have a padding of fibrous material that protects the user in the event of misuse of the chain saw and contact of the chain with the user's leg. U.S. Pat. No. 4,351,065 discloses a design of padded trousers to protect a chain saw user from a saw that may go out of control. Various patents exist disclosing armored vests, as for example, U.S. Pat. No. 3,582,988. The jacket of the present invention would be typically worn by chain saw users that are involved in trimming branches off trees, as for example, those who cut branches that are interfering with power lines or telephone lines along roadways. Conventionally the user stands in a device that is raised off the ground and the user is reaching up to tree branches that require removal. In such situations the upper part of the body including his shoulders and chest are exposed in close proximity to the saw chain and subject to injury if the saw chain becomes even slightly out of control as by kick back of the saw or other reason. Because the cutting is done with the arms raised and the chain saw at the level of the upper part of the body or the higher it is, the chest and upper shoulders are subject to injury. It is to this general problem that the present invention is directed.

SUMMARY OF THE INVENTION

The invention consists of a sleeveless jacket extending from the shoulders down below the user's waist. The upper part of the jacket including the shoulders and the front portion are padded with a fibrous material that when it comes in contact with the saw chain serves to promptly jam the chain. The lower part of the jacket is unpadded and the two sections are joined together to permit air flow and ventilation to the chain saw worker. An additional feature is that there are no outside pockets on either the upper or lower part of the jacket which could present a hazzard by catching on to branches.

Accordingly it is an object of the present invention to provide a protective jacket that will fully protect the chest and shoulders of the user of a chain saw.

Another object of the present invention is to provide a protective jacket in which the front chest portion and shoulders are padded with a chain saw protective fibrous material.

A further object of the present invention is to provide a protective jacket for a chain saw user that does not bind or inhibit the movement of the upper part of his body in positioning the chain saw.

BRIEF DESCRIPTION OF THE DRAWINGS

The foregoing and still other objects and advantages of the present invention will be more apparent form the following detailed explanation of the preferred embodiments of the invention in connection with the accompanying drawings herein in which.

DESCRIPTION OF THE PREFERRED EMBODIMENT

Figure 1:
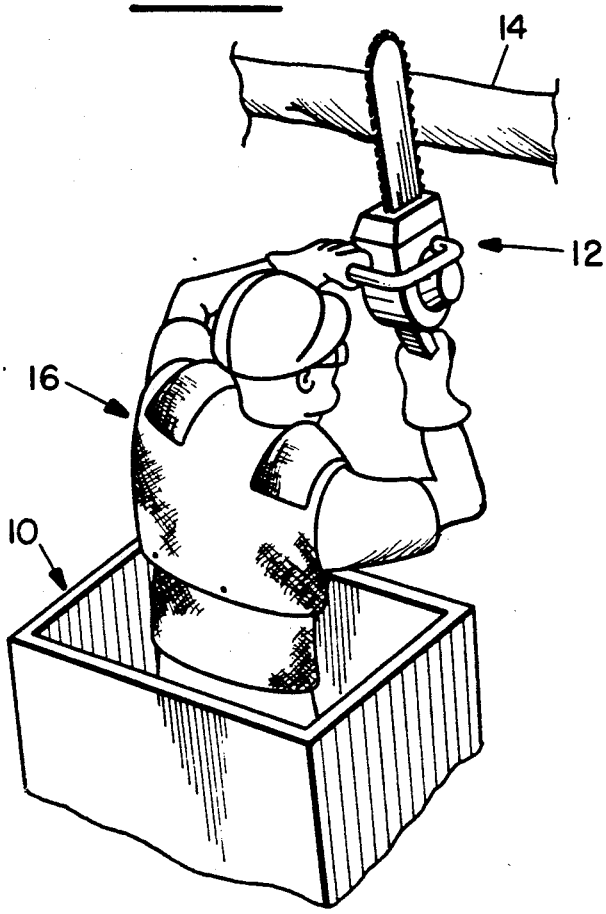
FIG. 1 is a perspective view of a chain saw operator wearing a jacket of the present invention and cutting a tree branch.
Figure 2:
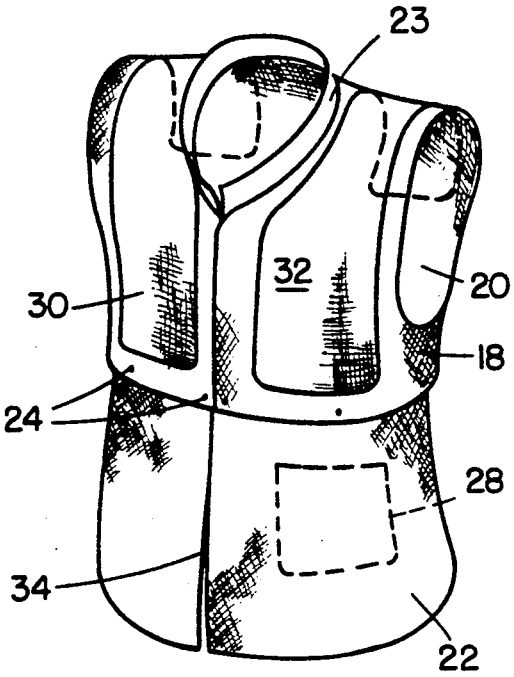
FIG. 2 is a perspective view showing the front of the jacket.
Figure 3:
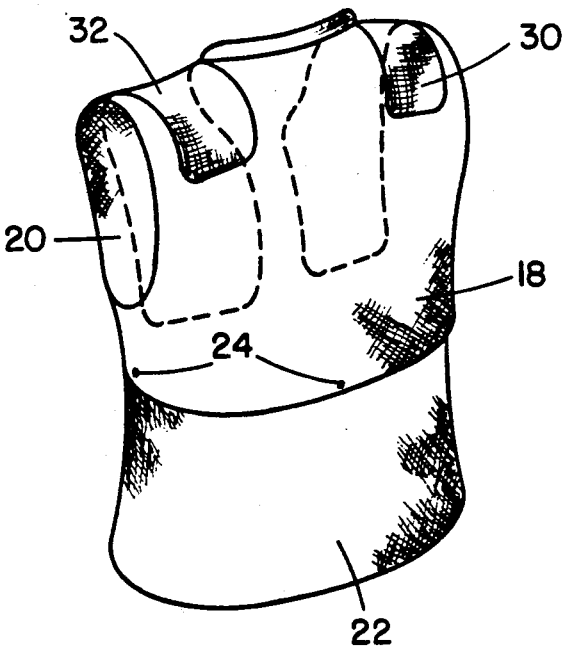
FIG. 3 is a perspective showing the back of the jacket.
Figure 4:
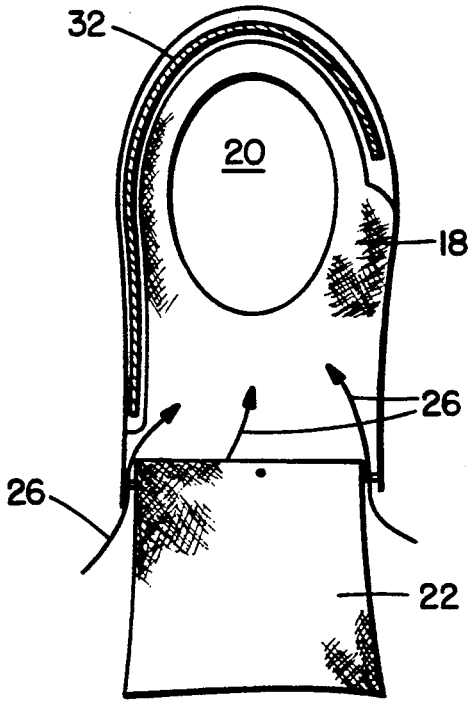
FIG. 4 is a left side view of the jacket.

Referring now to FIG. 1 there is shown a chain saw operator who may be located in a small enclosure 10 that through appropriate mechanism is raised above the ground to reach upper tree limbs that might, for example, be interfering with electrical or telephone wires. The operator is using a chain saw 12 to cut a tree limb 14 in which the limb is above the operator leaving his chest and shoulders exposed to the area of operation of the chain saw. The operator is wearing a vest of the present invention generally indicated by numeral 16 and shown in greater detail in FIGS. 2 through 4.

The jacket is made up of an upper vest portion 18 that surrounds the wearer at the upper portion of his chest and back. This portion 18 is sleeveless and provides openings 20 where the sleeves would otherwise be connected. A collar 23 encircles the neckline of the member 18.

A lower or skirt portion 22 is designed to surround the wearer about his waist area and is secured to portion 18 at discrete points 24 which may be sewed locations. In this manner vent areas are provided so that air can enter inside the upper or vest portion as shown by arrows 26 in FIG. 4. The large openings 10 also aid providing ventilation for the user. The skirt portion 22 may have one or more inside pockets as 28 in FIG. 2. Preferably there are no outside pockets on the garment which would be hazardous to the operator by catching onto branches or other items.

Both of upper or vest portion 18 and the skirt portion 22 may be made of a material such as nylon which provides flexibility and comfort to the wearer. Two sheets of padding material 30 and 32 are sewed to the vest portion 18 to cover the upper chest area of the operator. It is seen that these pads extend backward over the shoulder and as a result protect the user's chest and shoulders.

The padding material may take various forms and it has been found that one especially effective type is a fibrous padding known as Prolar and sold by the Elvex Corporation of Bethel, CT. Another example of a type of padding material for the purpose of jamming a saw chain is that disclosed in U.S. Pat. No. 4,280,342. In the event that the rotating saw chain comes in contact with the padding, the fibers will be drawn into the chain saw sprocket to jam and stop the operation of the saw and in that manner preventing or minimizing injury to the user.

A zipper 34 is provided at the front edges of both the upper vest portion 18 and lower skirt portion 22 to close the garment.

Thus it is seen that a garment is provided to protect the upper body portions of a chain saw operator. It has special utility for the use of chain saws in cutting overhead tree limbs where the upper portion of the body is particularly exposed.

Having thus described the invention with particular reference to the preferred forms thereof, it will be obvious that various changes and modifications may be made therein without departing from the spirit and scope of the invention as defined in the appended claims.

What is claimed is:

1. A sleeveless jacket for protecting the chest and shoulders of an operator of a chain saw comprising:

an upper sleeveless portion adapted to fully encircle the upper chest and upper back of a wearer and extend over the shoulders and having a lower edge;

a lower skirt portion adapted to fully encircle the waist of a wearer and having an upper edge;

means to secure the upper edge of the skit portion to the lower edge of the upper sleeveless portion at discreet locations at the front, sides and back of the sleeveless portion and skirt, thereby providing vent openings whereby air circulation can occur within the upper portion;

zipper means to close the front of the sleeveless portion and the skirt;

said upper portion and lower skirt portion being of a flexible fabric material;

collar means encircling the neckline of the said sleeveless portion;

protective padding means comprising fibers secured to the front chest and shoulder areas of the said upper portion adapted to jam the mechanism of a chain saw upon the blade cutting into the padding by pulling the fibers into the mechanism.

2. A sleeveless jacket as set forth in claim 6 including at least one inside pocket and no outside pockets.

3. A sleeveless jacket for protecting the chest and shoulders of a user of a chain saw comprising;

an upper sleeveless portion adapted to encircle the upper chest and upper back of a wearer and extend over the shoulders and having a lower edge;

a lower skirt portion adapted to fully encircle that waist of a wearer and having an upper edge;

means to secure the upper edge of the skirt portion to the lower edge of the upper sleeveless portion at discreet locations thereby providing vent openings whereby air circulation can occur within the upper portion;

said upper portion and lower skirt portion being of a flexible fabric material;

protective padding means comprising fibers secured to the front chest and shoulder areas of the said upper portion adapted to jam the mechanism of a chain saw upon the blade cutting into the padding by pulling the fibers into the mechanism.

4. A sleeveless jacket as set forth in claim 3 including at least one inside pocket and no outside pockets.

* * * * *